US005103627A

United States Patent [19]

Stadele et al.

[11] Patent Number: 5,103,627

[45] Date of Patent: Apr. 14, 1992

[54] APPARATUS FOR TRANSPORTING SPINNING TUBES TO AND FROM A TEXTILE SPINNING MACHINE

[75] Inventors: Norbert Stadele, Goppingen; Martin Maeser, Albershausen; Johann Balsasch, Oberkochen, all of Fed. Rep. of Germany

[73] Assignee: Zinser Textilmaschinen GmbH, Ebersbach/Fils, Fed. Rep. of Germany

[21] Appl. No.: 554,251

[22] Filed: Jul. 17, 1990

[30] Foreign Application Priority Data

Jul. 26, 1989 [DE] Fed. Rep. of Germany ..... 3924710

[51] Int. Cl.[5] ..... D01H 9/00; B65G 47/26

[52] U.S. Cl. ..... 57/281; 57/90; 198/419.3

[58] Field of Search ..... 57/281, 90; 198/419.3, 198/733

[56] References Cited

U.S. PATENT DOCUMENTS 3,307,340 3/1964 Nishii et al. ..... 57/275
4,325,479 4/1982 Pirovano ..... 198/733
4,724,772 2/1988 Krogsrud ..... 198/733
4,964,269 10/1990 Dinkelmann ..... 57/281

FOREIGN PATENT DOCUMENTS 2560655 10/1985 France ..... 198/834

*Primary Examiner*—Daniel P. Stodola
*Assistant Examiner*—William Stryjewski
*Attorney, Agent, or Firm*—Shefte, Pinckney & Sawyer

[57] ABSTRACT

Apparatus for transporting spinning tubes mounted on peg trays for supply and removal of spinning tubes to and from a textile spinning machine comprises an endless upstanding conveyor belt to which a plurality of transport members are affixed at spacings therealong. Each transport member has a recess at its opposite leading and trailing sides such that the leading and trailing recesses of adjacent succeeding transport members are cooperative for receiving therebetween a peg tray. Each transport member also has a concave arcuate guide surface at its opposite leading and trailing sides such that the leading and trailing guide surfaces of adjacent succeeding transport members define an enclosure for securely positioning a peg tray therebetween.

6 Claims, 4 Drawing Sheets

APPARATUS FOR TRANSPORTING SPINNING TUBES TO AND FROM A TEXTILE SPINNING MACHINE

BACKGROUND OF THE INVENTION

The present invention relates to an apparatus for transporting spinning tubes supported on tube support members for use in supplying empty spinning tubes to, and removing fully-wound spinning tubes from, a textile spinning machine of the type having multiple spinning stations.

Spinning tube transport apparatus of the aforementioned type are used in particular in textile spinning machines having spinning stations along each of two opposite sides thereof, e.g., conventional ring spinning machines. Typically, such a transport apparatus utilizes a driven transport arrangement which travels alongside the spinning stations and includes a plurality of spaced transport members for engaging and transporting therewith support members, e.g., peg trays, on which spinning tubes are supported, thereby to align the tube support members in spaced relation corresponding to the spacing between the spindles of the spinning stations.

West German Offenlegungsschrift DE 37 12 027 A1 discloses a spinning tube transport apparatus wherein transport elements are provided along each opposite side of the spinning machine and are driven in a reciprocating back-and-forth motion. The transport elements are provided with suitable means for engaging peg tray-type spinning tube support members only when moving in one direction, by which the spinning tube support members are aligned with the spinning stations in proper position for an automatic bobbin replacement operation. A U-shaped guide track extends about the spinning machine for movement of the support members along the track, the opposite sides of the track being connected at one end of the machine to mechanisms for infeed and discharge of the tube support members to and from the track.

West German Patent Application No. P 38 12 342.8 discloses a spinning tube transporting apparatus wherein a transport arrangement in the form of an endless metal band or belt is directed about suitable guide or deflection rollers in a generally upstanding relation to travel along each opposite side of a spinning machine. The upstanding transport belt is adapted to engage and transport peg tray-type tube support members slidably along a guide track. In conventional fashion, each peg tray has a main plate-like body from which a central support pin extends upwardly for mounting of a spinning tube on the peg tray. The peg trays are aligned by the transport arrangement at spacings corresponding to the spacing of the spindles of the spinning machine, making it possible to exchange empty spinning tubes for fully-wound spinning tubes on the machine spindles by means of an automatic tube replacement apparatus.

In German Patent Application No. P 39 18 876.0, a spinning tube transporting apparatus is disclosed which utilizes a driven transport arrangement having carrier elements affixed thereto to serve as support receptacles for tube-supporting peg trays. The transport arrangement includes guide elements which travel slidably in a guide track extending along the longitudinal sides of the spinning machine, the guide track having a guiding edge along which the support pins of the peg trays travel.

SUMMARY OF THE INVENTION

It is an object of the present invention to provide an apparatus for transporting spinning tubes mounted on spinning tube support members, such as peg trays, to and from the spinning stations of a textile spinning machine, which achieves precise alignment of the spinning tube support members with one another.

According to the present invention, this objective is achieved by a transport apparatus which is equipped with a driven endless transport means having plural cooperative transport members spaced therealong for supporting and carrying spinning tube support members therebetween. Specifically, the driven transport means extends in endless form about the spinning machine alongside its spinning station for conveying spinning tubes supported on tube support members. Each of the transport members spaced along the transport means defines a recess at opposite leading and trailing sides of the transport member in the direction of travel of the transport means. The leading and trailing recesses of each pair of adjacent succeeding transport members are cooperative for receiving a tube support member. Each transport member also has a guide surface at its opposite leading and trailing sides, the leading and trailing guide surfaces of each pair of adjacent succeeding transport members defining an enclosure for a tube support member.

Advantageously, a transport apparatus under the present invention exhibits a particularly simple design in comparison to known spinning tube transporting apparatus in that the provision of an auxiliary separate guide track, slide plate, or other support for the spinning tube support members, as is typically utilized in known transport apparatus, have been eliminated.

Instead, the leading and trailing recesses formed in the spaced transport members receive and carry the spinning tube support members without need for any auxiliary support of the tube support members. Additionally, the transport apparatus is operative to convey the spinning tube support members in a particularly reliable manner with little friction. The guide surfaces provided on each transport member serve to precisely align the tube support members with one another along the extent of the transport arrangement traveling alongside the spinning positions, by means of the enclosure of each tube support member by the guide surfaces of adjacent succeeding transport members. Also, the endless driven transport means of the present invention is especially economical in that only one drive unit is required for the transport means.

In the preferred embodiment, the present transporting apparatus is adapted for operation with spinning tube support members of the peg tray type having a main plate-like body and a cylindrical tube mounting pin centrally upstanding therefrom, preferably with an enlarged cylindrical collar about the base of the pin. According to the present invention, each guide surface of each transport member is configured in conformity to the collar of the pin, preferably as a sector of a circle of a diameter corresponding to that of the pins or collars of the tube support members. In this manner, each guide surface contacts the pin or collar of a peg tray over a relatively large contact surface, which provides a secure engagement without substantial wear. Further, peg trays having main bodies of different sizes can be utilized at the same time so long as their respective pins or collars are of the same diameter.

Preferably, the opposite guide surfaces of each transport member are located at opposite transverse sides with respect to a line of travel of the transport means, each leading guide surface preferably being located at the side of the line of travel adjacent the spinning stations and each trailing guide surface preferably being located at the side of the line of travel outwardly from the spinning stations. In this manner, the peg tray or other spinning tube support members carried between successive transport members is gripped thereby diagonally with respect to the direction of travel of the transport means, which produces a precise and stable positioning of the support member transversely with respect to its direction of transport.

It is additionally preferred that each transport member have a curved discharge surface extending from its leading guide surface transversely outwardly with respect to the transport means at an increasing dimension therefrom In this manner, an automatic discharge of the tube support members from the transport apparatus at a discharge location therealong is assured. Additional means for discharging the tube support members are therefore not necessary.

In the preferred embodiment of the present spinning tube transporting apparatus, each transport member includes substantially horizontal support surfaces bordering its leading and trailing recesses for supporting thereon the spinning tube support members.

It is additionally preferred that the transport members be provided with upstanding pins for supporting empty or fully-wound spinning tubes, thereby to eliminate any need for additional devices for intermediary positioning of spinning tubes during a tube replacement procedure.

DESCRIPTION OF THE PREFERRED EMBODIMENT

Figure 1:
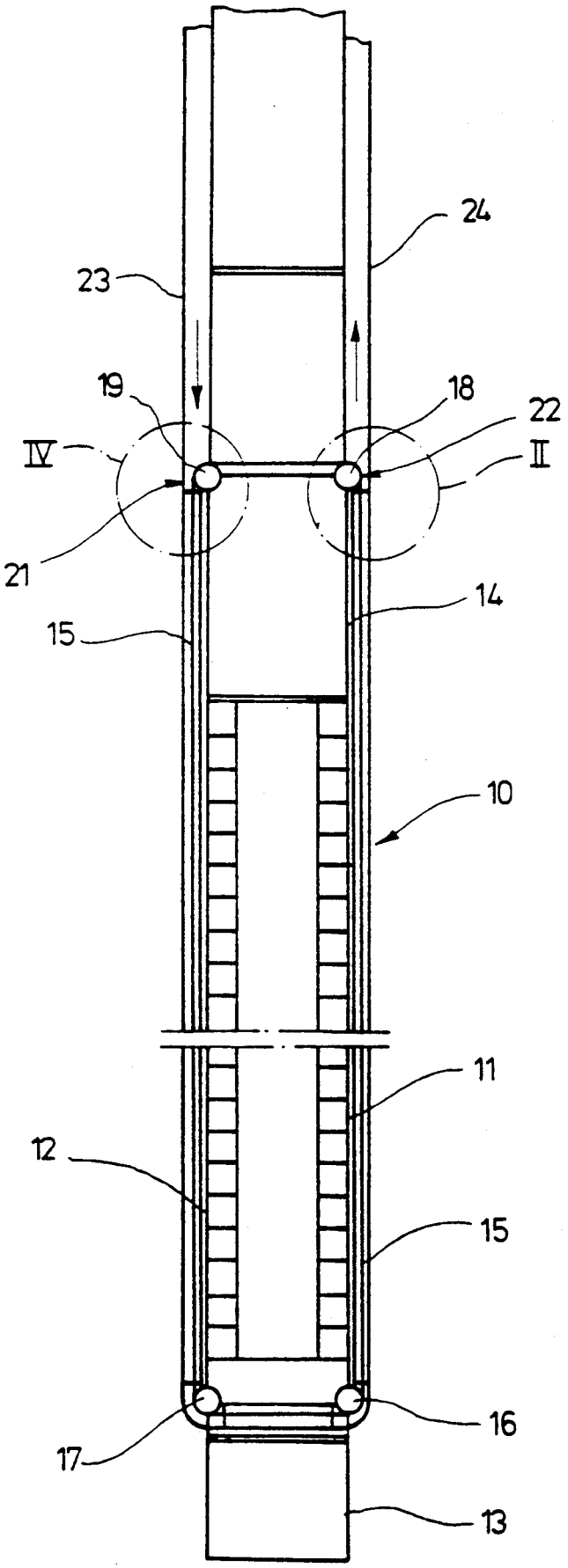
FIG. 1 is a schematic top plan view of a spinning tube transporting apparatus according to the present invention as preferably embodied for use with a conventional double-sided textile ring spinning machine.

Referring now to the accompanying drawings and initially to FIG. 1, a spinning tube transporting apparatus according to the preferred embodiment of the present invention is shown as preferably embodied in a textile ring spinning machine, broadly indicated at 10, of the conventional double-sided type having an elongated longitudinal frame with a plurality of spinning stations, shown only schematically at spaced along each opposite longitudinal side of the machine between its opposite end frame members 13,14. Ring spinning machines of this conventional type are well-known to those persons skilled in the art and need not be described more fully herein.

Figure 2:
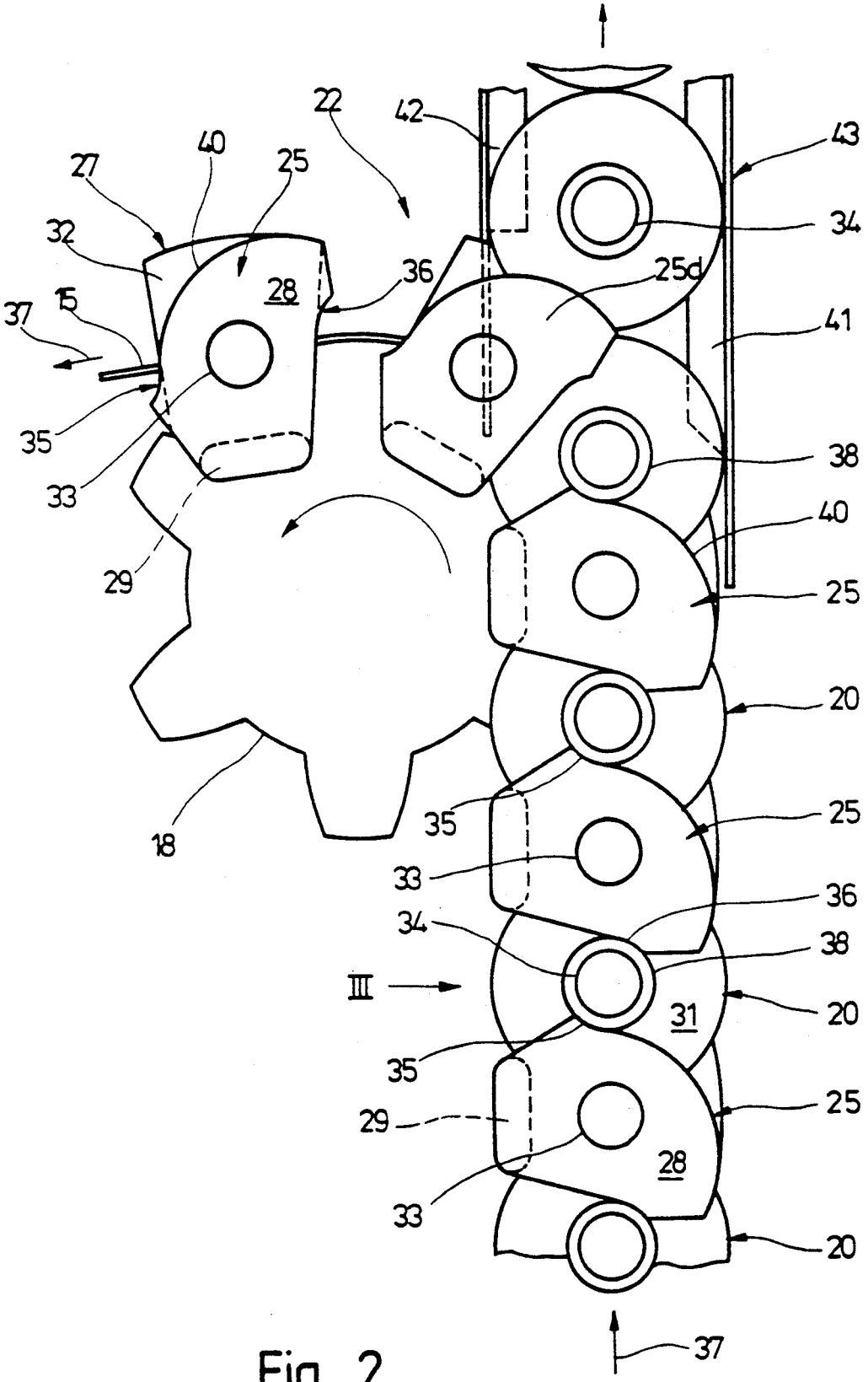
FIG. 2 is an enlarged top plan view of a section of the transporting apparatus of FIG. 1 shown at II thereof.
Figure 3:
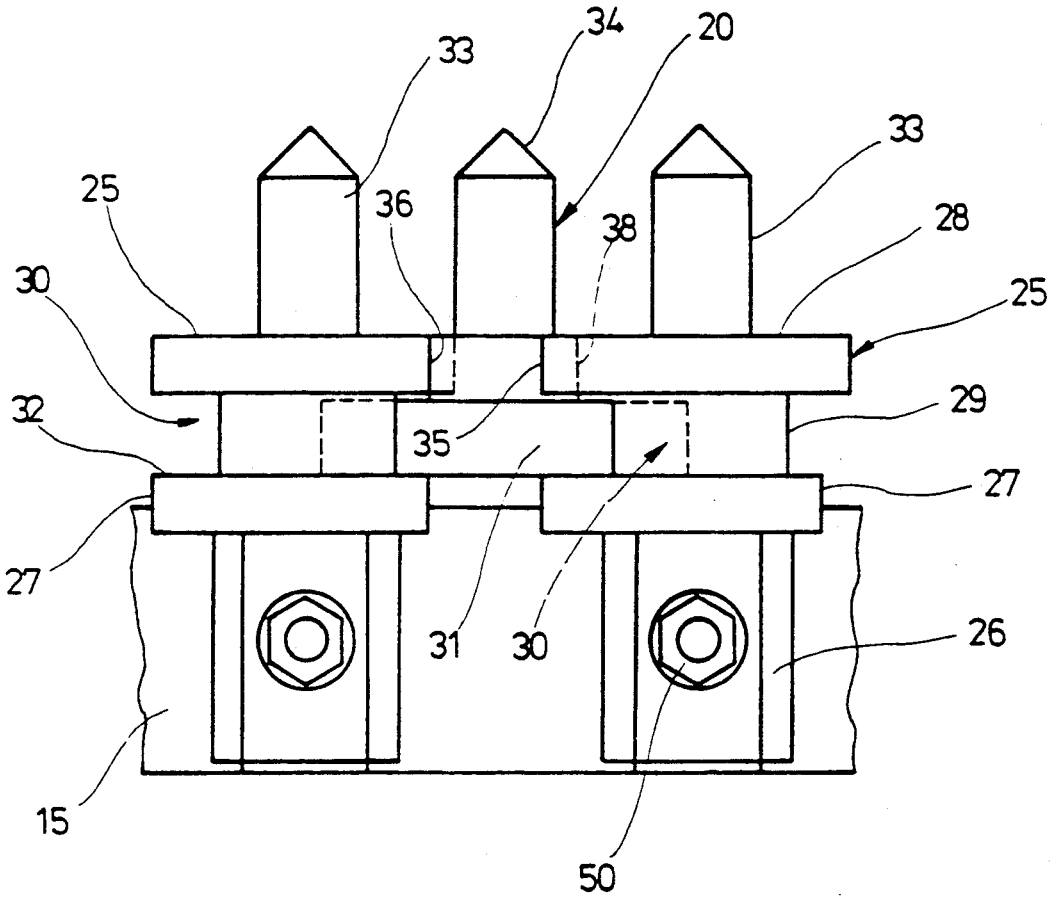
FIG. 3 is an enlarged side elevational view of a section of the transporting apparatus of FIG. 1 as viewed at III of FIG. 2.
Figure 4:
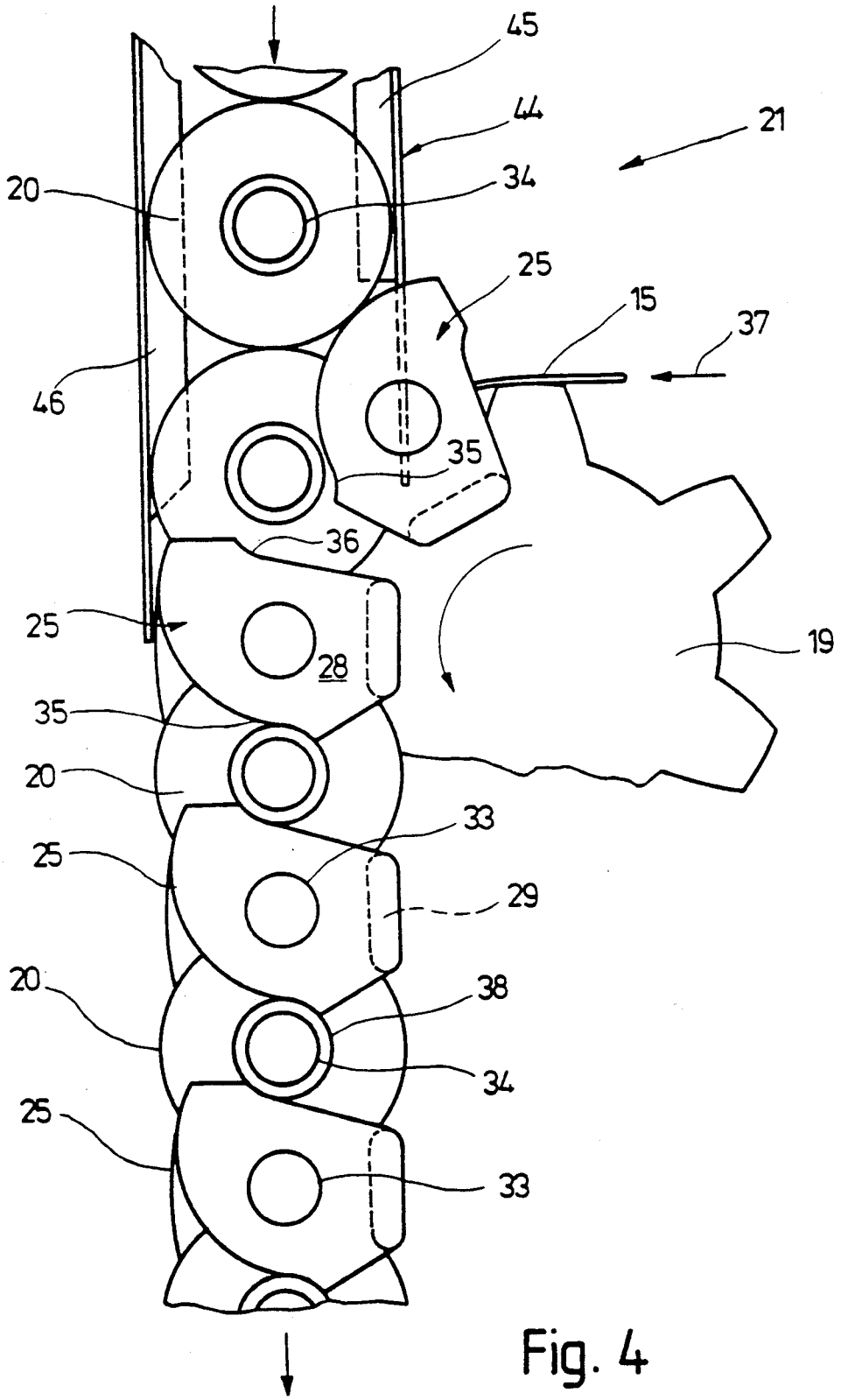
FIG. 4 is another enlarged top plan view of a section of the transporting apparatus of FIG. 1 shown at IV thereof.

The present spinning tube transporting apparatus includes an endless driven belt 15 trained about toothed gear-type guide wheels 16,17,18,19 at opposite corners of the spinning machine 10 to extend in endless fashion about the machine and alongside its spinning stations 11,12. The belt 15 preferably is an endless flexible steel or other metal belt having a substantially flat lateral extent and is oriented by the guide wheels 16,17,18,19 with its flat lateral extent in generally upstanding relation facing the spinning machine 10, as shown in FIGS. 2–4. At least one of the gear-type guide wheels 16,17,18,19 is operatively connected to a drive motor or other suitable drive unit (not shown) for driving the belt 15 to travel about the spinning machine 10.

The transporting apparatus of the present invention is adapted for operation in connection with spinning tube support members 20 of the peg tray type having a circular disk-like main body 31 and a cylindrical mounting pin 34 upstanding centrally therefrom. Preferably, the pin 34 of each peg tray 20 is equipped with a cylindrical collar 38 of relatively enlarged diameter about the base of the upstanding pin 34. As more fully described below, the transport apparatus of the present invention is adapted to convey the peg trays 20 to and from the spinning stations 11,12 of the ring spinning machine 10 by the driven traveling movement of the belt 15. As shown in FIG. 1, peg trays 20 are delivered to the transporting apparatus at an infeed position 21 and are released from the transporting apparatus at a discharge position 22 respectively located at opposite sides of the spinning machine 10 at the end of its end frame member 14. The conveyance of peg trays 20 to the infeed position 21 and from the discharge position 22 can be accomplished in any suitable manner, such as via infeed and discharge conveyor belts 23,24, respectively, oppositely driven as indicated by the directional arrows in FIG. 1.

The present transport apparatus is shown in FIG. 2 in enlarged detail in the area of the discharge position 22. According to the present invention, the transport apparatus includes a plurality of transport members 25 each having a foot portion 26 by which the transport members 25 are affixed by fastening elements 50 to the outwardly facing surface of the belt 15 at uniform spacings therealong. The foot portion 26 of each transport member 25 serves as a guide element for guided sliding movement in a guide track (not shown) together with another guide element (also not shown) located at the opposite side of the belt 15. In this fashion, the transport members 25 are supported in a horizontal and vertical direction on the guide track.

The upper extent of each transport member 25 is of a generally U-shaped cross section and comprises a lower support plate 27 and an upper guide plate 28 connected at a vertical spacing from one another by a vertically extending intermediate connection portion 29. As shown particularly in FIG. 3, the spaced support and guide plates 27,28 and intervening connection portion 29 of each transport member 25 define a forward recess 30 at the leading side of the transport member, as viewed in its direction of travel with the belt 15, and a rearward recess 30 at the trailing side of the transport member 25. Thus, the leading and trailing recesses 30 of each pair of adjacent succeeding transport members 25 face one another and, according to the present invention, the spacing between the transport members 25 and the configuration of their respective recesses 30 are established such that each pair of adjacent succeeding transport members 25 is cooperative to receive and support a peg tray 20 therebetween with its main body 31 disposed within the respective leading and trailing recesses 30 resting on the horizontally extending upper support surfaces 32 of the respective support plates 27 and with its collar portion 38 and mounting pin 34 extending upwardly between the respective guide plates 28. The vertical dimension of each recess 30 as determined by the vertical spacing between the support and guide plates 27,28 of each transport member 25 is slightly greater than the vertical thickness of the main body 31 of each peg tray 20 to enable the peg trays 20 to be readily introduced and removed from between adjacent transport members 25 at the infeed and discharge locations 21,22. In this manner, the transport members 25 cooperate with one another to act as carrier elements for the peg trays 20 operative to reliably transport the peg trays 20 with minimal imposition of frictional forces on the peg trays 20.

Each of the transport members 25 is equipped with a mounting pin 33 upstanding centrally from its guide plate 28, each pin 33 being of substantially the same configuration as the mounting pins 32 of the peg trays 20. As shown in FIG. 3, the mounting pins 33 on the transport members 25 extend upwardly to substantially the same height as the mounting pins 34 of the peg trays 20 in their transport disposition supported between the transport members 25.

As shown in FIGS. 2 and 4, the leading and trailing edges of the upper guide plate of each transport member 25, as viewed in the direction of travel thereof, include an edge portion at 35,36, respectively, which forms a guide surface, the respective leading and trailing guide surfaces 35,36 of each pair of adjacent succeeding transport members 25 being thereby located to face one another to define an enclosure area therebetween for engaging the collar portion 38 of a peg tray 20 to retain it in place between the transport members 25. Preferably, the respective leading and trailing guide surfaces 35,36 of each transport member 25 are staggered or offset with respect to the center line of travel of the transport members 25, as indicated by the directional arrows 37, such that the guide surfaces 35,36 are located at opposite transverse sides with respect to the line of travel 37, each leading guide surface 35 being located at the inward side of the line of travel adjacent the spinning stations of the spinning machine and each trailing guide surface 36 being located at the outward side of the line of travel outwardly from the spinning stations of the spinning machine. As a result, the collar portion 38 of each peg tray 20 is engaged and gripped by the guide surfaces 35,36 of the associated pair of adjacent transport members 25 transversely, particularly diagonally, with respect to the direction of travel 37, which achieves a secure and reliable positioning of each peg tray 20.

Thus, the guide surfaces 35,36 on the transport members 25 serve to align the peg trays 20 transported by the present transporting apparatus substantially in a linear row during travel alongside the spinning stations 11,12 of the ring spinning machine 10. Particularly, the pins 34 of the peg trays 20 are linearly aligned with one another in such region and also in line with the pins 33 of the transport members 25, as seen in FIGS. 2 and 4, which reliably accommodates and improves the operation of an associated automatic tube replacement apparatus (not shown) for carrying out an automatic removal, or doffing, of fully-wound spinning tubes from the spindles of the spinning machine and replacement, or donning, of empty spinning tubes onto the spindles.

As seen in FIGS. 2 and 4, each guide surface 35,36 is of a concave curved configuration, preferably in the form of an arcuate sector of a circle of a diameter or radius corresponding to the collar portion 38 of the pins 34 of the peg trays 20, whereby facing leading and trailing guide surfaces 35,36 of adjacent succeeding transport members 25 conform to the shape and diametric dimension of the collar portions 38. As a result, the transport members 25 are adapted to precisely align the peg trays 20 with one another without regard to the diameter of the main body 31 of the peg trays 20, which as aforementioned enables peg trays 20 having differently sized main bodies to be utilized.

The leading edge of each transport member 25 also includes a convex arcuate portion at 40 extending from the guide surface 35 transversely outwardly with respect to the transport belt 15 at an increasing dimension therefrom, as best seen from the transport member **25*d* in FIG. 2 in the area of the guide wheel 18, which transport member 25*d* has just released and no longer carries a peg tray 20. Thus, it will be seen that the leading edge of the guide plate 28 of each transport member 25 is of a generally S-shape defined by the guide surface 35 and the discharge surface 40. As a result of the convex curvature and dimensioning of the discharge surface 40, each peg tray 20 is discharged from between the associated pair of adjacent succeeding transport members 25 at the discharge position 22 in the area of the guide wheel 18 whereat the belt 15 and the transport members 25 change direction, the discharge surface 40 causing the collar portion 38 of the peg tray 20 to slide along the discharge surface 40 to maintain its linear path of travel. The upper support surface 32 of the support plate 27 of each transport member 25 is of a relatively larger horizontal dimension than the associated guide plate 28 in the area immediately below its discharge surface 40 to maintain support of the main body 31 of the peg tray 20 as it slides along the discharge surface 40 until the peg tray 20 is received by a discharge arrangement, broadly indicated at 43, at the discharge position 22. As shown in FIG. 2, the discharge arrangement 43 includes guide rails 41,42 extending in line with opposite lateral side edges of the discharge conveyor belt 24 longitudinally from a point immediately below the transport members 25 at the discharge location 22 to the discharge conveyor belt 24 to guide the discharged peg trays 20 onto the conveyor belt 24**.

FIG. 4 shows the transport apparatus in the area of the infeed position 21 whereat peg trays 20 are delivered to and received by the present transport apparatus. At this location, an infeed arrangement 44 is provided of substantially similar construction as the discharge arrangement 43, the infeed arrangement 44 including the aforementioned delivery conveyor belt 23 and a pair of guide rails 45,46 extending from the terminal end of the conveyor belt 23 in line with the opposite lateral edges thereof to a point immediately below the transport members 25 at the infeed location 21. The forward motion of the delivery conveyor belt 23 acts through peg trays 20 supported thereon to exert a pushing force on peg trays 20 in line on the guide rails 45,46 awaiting advancement to the present transport arrangement. Thus, the leading peg tray 20 at the forward end of the guide rails 45,46 is advanced and received between two successive transport members 25 as they travel in succession about the guide wheel 19 at the infeed position 21, as illustrated in FIG. 4. The outer guide rail 46 is of a slightly greater lengthwise extent that the inner guide rail 45 to support each peg tray 20 until it is securely received on the support surfaces 32 of the support plates 27 of the succeeding transport members 25. As the transport members 25 complete their travel about the guide wheel 19, the collar portion 38 of the upstanding pin 34 of the peg tray 20 is securely enclosed between the guide surfaces 35,36 of the successive transport members 25.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. Apparatus for transporting spinning tubes mounted on spinning tube support members for use in supplying empty spinning tubes to, and removing fully-wound spinning tubes from, a textile spinning machine having plural spinning stations, said apparatus comprising driven transport means extending in endless form about the spinning machine alongside its spinning stations for conveying spinning tubes supported on the support members, said transport means having a plurality of transport members at spacings therealong, each said transport member having a recess formed in opposite leading and trailing sides thereof in the direction of travel of said transport means, said leading and trailing recesses of each pair of adjacent succeeding transport members being cooperative for releasably containing and supporting the weight of an independent tube support member, and each said transport member having a guide surface at its said opposite leading and trailing sides, said leading and trailing guide surfaces of each pair of adjacent succeeding transport members being cooperative for engaging a portion of a tube support member contained in said leading and trailing recesses of said adjacent succeeding transport members.

2. Apparatus for transporting spinning tubes according to claim 1 and characterized further in that each tube support member has an upstanding pin, each said guide surface being configured in conformity to said pin.

3. Apparatus for transporting spinning tubes according to claim 2 and characterized further in that each said upstanding pin is of a cylindrical configuration and each said guide surface is configured as a sector of a circle of a diameter corresponding to said pins.

4. Apparatus for transporting spinning tubes according to claim 1 and characterized further in that said opposite guide surfaces of each said transport member are located at opposite transverse sides with respect to a line of travel of said transport means, each said leading guide surface being located at the side of said line of travel adjacent the spinning stations and each said trailing guide surface being located at the side of said line of travel outwardly from the spinning stations.

5. Apparatus for transporting spinning tubes according to claim 1 and characterized further in that each said transport member comprises a curved discharge surface extending from said leading guide surface of said transport member transversely outwardly with respect to said transport means at an increasing dimension therefrom.

6. Apparatus for transporting spinning tubes according to claim 1 and characterized further in that each said transport member comprises substantially horizontal support surfaces for the spinning tube support members.

* * * * *